US006253427B1

(12) United States Patent
Gerson

(10) Patent No.: US 6,253,427 B1
(45) Date of Patent: Jul. 3, 2001

(54) SPRING CLIP AND METHOD FOR MAKING SAME

(76) Inventor: Stuart Gerson, 159 Fields Rock La., Fairfield, CT (US) 06430

( * ) Notice: Subject to any disclaimer, the term of this patent is extended or adjusted under 35 U.S.C. 154(b) by 0 days.

(21) Appl. No.: 09/340,238

(22) Filed: Jul. 1, 1999

(51) Int. Cl.[7] ..... A44B 17/00
(52) U.S. Cl. ..... 24/668
(58) Field of Search ..... 24/668, 666, 701, 24/546, 67.9, 3.6, 265 AL

(56) References Cited

U.S. PATENT DOCUMENTS

| | | | | |
|---|---|---|---|---|
| 403,609 | * | 5/1889 | Pickhardt | 24/668 |
| 455,710 | * | 7/1891 | Gemmell | 24/668 |
| 653,315 | * | 7/1900 | Richardson | 24/668 X |
| 867,949 | * | 10/1907 | Comstock | 24/668 |
| 903,376 | * | 11/1908 | Hay | 24/668 |
| 1,762,264 | * | 6/1930 | Domkee | 24/668 |
| 1,775,098 | * | 9/1930 | Hodge | 24/668 |
| 1,776,494 | * | 9/1930 | Domkee | 24/668 |
| 1,850,346 | * | 3/1932 | Francisco | 24/701 |
| 1,936,057 | * | 11/1933 | Hodge | 24/666 |
| 2,332,626 | * | 10/1943 | Elwell | 24/668 |
| 2,446,081 | * | 6/1948 | Miskimen | 24/666 |
| 3,911,537 | * | 10/1975 | Mazur | 24/668 |
| 4,271,999 | * | 6/1981 | Stravitz | 24/668 |
| 4,935,997 | * | 6/1990 | Hirsch | 24/668 |
| 5,706,561 | | 1/1998 | Kipperman . | |

FOREIGN PATENT DOCUMENTS

| | | | | |
|---|---|---|---|---|
| 74111 | * | 1/1918 | (AT) | 24/668 |

* cited by examiner

*Primary Examiner*—Lynne H. Browne
*Assistant Examiner*—John R. Gottingham
(74) *Attorney, Agent, or Firm*—Steven J. Moore; Cummings & Lockwood

(57) ABSTRACT

An improved garment loop for engaging and disengaging a button is described which includes at least one aperture for receiving a pin element. In a preferred embodiment, the loop is manufactured from a single piece of wire which provides for resilient movement of a button receiving portion by way of an overlapping element structure comprising a horizontal strap bar which includes a pair of generally flat stamped elements engaged together with a riveted pin.

7 Claims, 2 Drawing Sheets

SPRING CLIP AND METHOD FOR MAKING SAME

FIELD OF USE

The invention relates generally to an improved spring clip for engaging buttons on garments and more specifically to a button loop for supporting shoulder straps on clothing.

BACKGROUND OF THE INVENTION

Currently most garment spring clips of the type used to support straps on overalls, commonly referred to as button loops or overall clips, consist of a wire loop form having a pair of arms which are shaped to provide a button receiving portion for engaging the stem of a button on a bib of a garment. The pair of arms are spring biased towards a closed position and are usually retained in alignment by a stamped piece of sheet metal, sometimes referred to as the encasement. The sheet metal also prevents the arms from being opened to such an extent as to deform the arms and remove their spring action. Examples of such devices are shown in U.S. Pat. No. 1,346,911 to C. E. Peterson; U.S. Pat. No. 1,775,101 to R. J. Hodge; U.S. Pat. No. 1,798,146 to J. H. Domkee; U.S. Pat. No. 1,824,547 to R. J. Hodge; U.S. Pat. No. 1,831,804 to J. H. Domkee; U.S. Pat. No. 1,832,191 to J. H. Domkee; U.S. Pat. No. 1,844,282 to R. J. Hodge; U.S. Pat. No. 1,844,283 to R. J. Hedge; U.S. Pat. No. 2,146,496 to C. E. Anderson; U.S. Pat. No. 4,935,997 to N. A. Hirsch; and U.S. Pat. No. 5,005,269 to N. A. Hirsch. The basic design for these two piece clips has changed little over the last seventy years.

The above two piece spring clips provided an improvement over prior one piece retention clips. The prior art one piece clips were wire forms or stamped metal which did not have any spring action. Rather, they simply slide over a button stem and retained a garment in place with simple gravitational forces. Thus, there was no spring tension to hold a clip onto the stem of a button. In certain applications, such as on children's clothing and during transportation of garments such as overalls, these prior art one piece clips were prone to falling off. The two piece clips which provide spring action to engage buttons had significant advantages over the prior art one piece clips and have been used extensively over the last seventy-five years.

Although two piece spring clip have been used extensively, the sheet metal encasement or retainers of the two piece button clips may be subject to unwanted deformation and breaking as a result of repeated washing in washing machines. When a garment using such a clip is washed the two piece clip may become entangled with other garment or pieces of the machine washer which pull on the wire loop or the encasement and cause the encasement to become loose or otherwise fall off. Although some manufacturers claim that certain configurations of encasements may provide improved performance over other designs in this respect, the problem persists and is inherent to any two piece loop known in the prior art.

As a result, one piece clips are still in use today. Examples of such devices are shown in U.S. Design Pat. No. 306,272 to J. B. Kruger and U.S. Pat. No. 56,042 to De Ver H. Warner, and U.S. Pat. No. 1,695,056 to C. A. Mosgrove; U.S. Pat. No. 3,911,537 to H. E. Mazur. In some case button loops have been formed from a single piece of sheet metal or plastic material, see, e.g., U.S. Design Pat. No. 358,567 to W. A. Sirois and U.S. Pat. No. 4,204,300 to G. Fildan.

As with the original one piece retention clips, prior art clips which are formed from a single piece of material or which are otherwise retained together through either a weld or support element tend to be too rigid and do not provide enough lateral movement to engage and disengage a metal button with ordinary spring force. In addition, pieces which are welded together tend to be problematic because they are subject to breakage after extensive use and washing.

To the extent that single wire button loops are formed to provide the necessary shape without welding or a support element to retain the wire ends together, i.e., the ends of the wire are simply put in an abutting relationship, the clip becomes subject to deformation upon repeated use and washing.

One prior art spring clip developed by Mississippi Trading, Inc., the assignee of the present invention, which is shown in FIG. 1, solved many of the problems with the prior art clips discussed above. These clips were made from one single piece of wire form, were sturdy, prevented children from being injured on sharp metal pieces and proved to be easy to use with adequate spring action. These clips however, use interlocking lateral elements which require that the metal be bent. The bent portions of the top arm may be too bulky for some fine cloth material which may be used in infants' and children's clothing.

SUMMARY OF THE INVENTION

It is therefore an object of the present invention to provide an improved spring clip which provides resilient lateral movement of a button receiving portion and a thinner construction of the horizontal bar.

The spring clip of the present invention is provided with a horizontal strap bar having at least one overlapping sliding element secured by a pin element to the other arm, a pair of arms extending from the horizontal bar and a button receiving portion for resiliently engaging a button like element. In a preferred embodiment the present invention provides for a pin to be secured to one of the overlapping arms and is slideably coupled to the other arm so that resilient movement of the arms is permitted. At least one of the arms is thereby provided with an opening running along the axis of motion of the horizontal bar. Alternatively, both arms could be provided with such an opening and a pin could be used to limit the motion of the arms relative to each other.

BRIEF DESCRIPTION OF THE DRAWINGS

The present invention will be understood and appreciated more fully from the following detailed description, taken in conjunction with the drawings, in which.

DETAILED DESCRIPTION OF THE INVENTION

Figure 1:
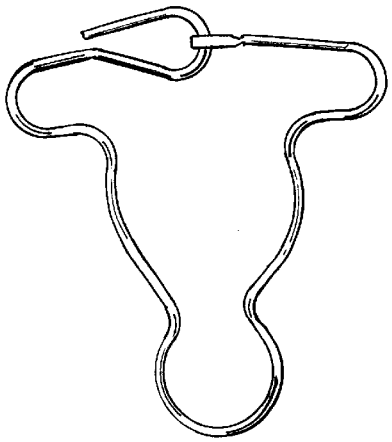
FIG. 1 (Prior Art)
FIG. 1 is a perspective view of a prior art spring clip.

By way of example, the present invention is discussed in terms of a spring clip used to secure a strap of a garment on a button type projection. The use of such clips are well in known in the art and are discussed briefly in U.S. Pat. No. 5,706,561 to Mississippi Trading, Inc., the assignee of the present invention. The example application described herein is only one example application of the present invention and is provided for the purpose of better explaining the present invention. The present invention may be applied to any number of other clips. Thus, the present invention should not be limited to the specific example described herein.

Generally speaking, the present invention is directed to an improved spring clip design that employs two overlapping elements in the horizontal bar strap which provide resilient expansion of a button receiving portion. The design is intended to provide adequate limited lateral movement of the horizontal bars to translate into sufficient expansion of a button receiving portion such as to comfortably receive a button and yet reduce the width requirements of the horizontal bar. The design also secures against over-expansion of the horizontal bars so that they are not overly extended, deformed or otherwise misalign.

In a preferred embodiment of the present invention the overlapping portions of the horizontal bar elements are stamped to a generally flat shape. One of the elements may then be provided with a hole and the other element may be provided with a slide aperture. A riveted pin element is then placed in the hole and aperture of the two elements and engaged in a manner well known in the art. The rivet must be provided with sufficient length, and of sufficiently narrow diameter, as to permit resilient movement of the two sliding elements. In other words, the rivet cannot be so tight as against the aperture or with respect to the length as to provide too much friction and thereby inhibit the resilient and lateral movement of the horizontal elements. When done properly, this construction provides for some lateral movement of the two horizontal bar elements as defined by the slide aperture of the two elements. The specific dimensions depend on the specific application, materials and would be well known in the art in view of the teachings of the present invention.

In an alternative preferred embodiment, both of the stamped ends of the elements are provided with slide apertures. This provides greater slide action without extending the length of the horizontal bars or the flatted areas of the bars. Rather than a riveted pin, any number of element structures could also be used to engage the two elements of the horizontal bar strap. A screw and bolt could be used, or a pin could be welded to one of the elements and slid through the aperture of the other element provided a head larger than the aperture opening is provided to keep the slide aperture from escaping the pin and other system obvious to those skilled in the art upon reviewing the teachings of the present invention.

Figure 2:
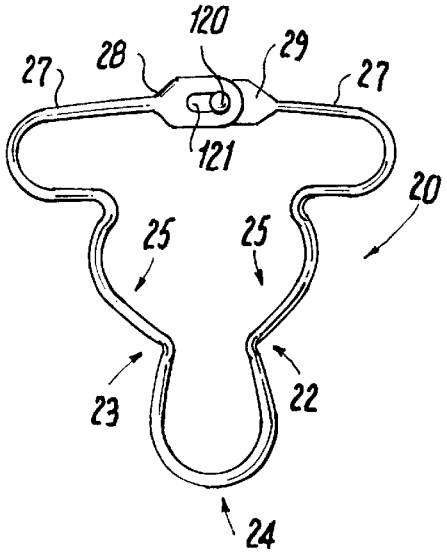
FIG. 2 is a perspective view of a first side a preferred embodiment of a spring clip embodying the present invention.
Figure 3:
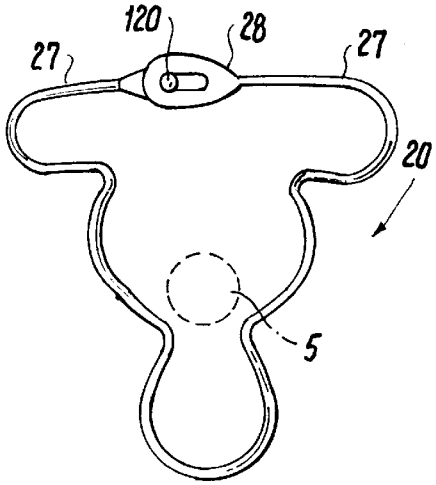
FIG. 3 is a perspective view of a second side of the preferred embodiment of a spring clip embodying the present invention shown in FIG. 2.

Referring to FIG. 1 a prior art spring clip 10 is shown. Illustrated in FIGS. 2 and 3 is a preferred embodiment of a spring clip of the present invention. In the preferred embodiment, the spring clip 20 is formed from a single piece of metal wire which is slidably engaged by a pin 120. The wire is shaped to provide a button receiving portion defined by elements 24, two bowed arms 22, 23 and a horizontal strap bar formed by two overlapping elements 28 and 29 and horizontal elements 27.

The button receiving portion 24 is shaped and sized to receive the stem of a button which is engaged to a garmet. Upon the application of pressure by the button stem projection on the walls 22, 23 of the button receiving portion 24, the inwardly bowed sections of the button receiving portion 22 and 23 are spread from their biased closed position and receive the button stem projection 5 until the button stem projection 5 is secured in the button receiving portion 24. Once the button stem 5 passes through the entry point defined by the bowed sections 22 and 23 it rests within the circumference of the button receiving portion 24 and is maintained in the button receiving portion 24 by the inwardly bowed sections 23 and 22 which return back to their normally closed biased position.

Spring clip 20 is provided with bowed arms 25 which are bent to bias the inwardly bowed sections 22 and 23 of the button receiving portion 24 in a closed position. When the button stem projection slides through the inwardly bowed sections 22 and 23, the inwardly bowed sections 22 and 23 and the arms 25 move in a lateral outward open position. The motion of the arms 25 is translated to the sliding horizontal bar elements 27. The horizontal sliding bar elements have pressed ends 28 and 29 which are slideably connected via at least one extended aperture with a rivet element 120 in such a manner as to limit the amount of lateral movement of the arms 25, and consequently the inwardly bowed sections 22 and 23. This limit is necessary for keeping the inwardly bowed sections 22 and 23 from opening to such an extent as to permanently deform the button receiving portion 24.

The overlapping ends 28 and 29 of the horizontal bar elements 27 are formed by stamping or otherwise pressing the wire to form a relatively flat surface which may be stamped to provide one horizontal aperture and one hole for receiving the rivet element. Thus one stamp would press the end and create the necessary aperture on each of the elements 28 and 29. The ends of the wire are preferably stamped in a manner such as to avoid sharp edges and then riveted together to form the horizontal bar elements 27 such that they are relatively lined up in a straight manner.

The spring clip described above may be easily coated with any number of coating materials used in the industry, such as nickel-color electroplating.

Figure 4:
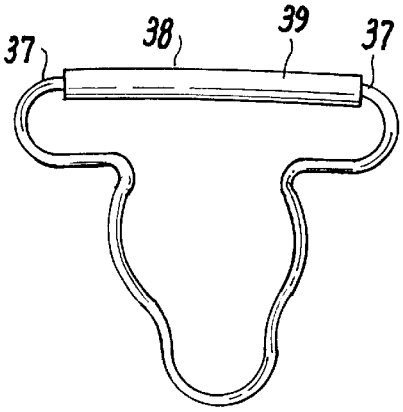
FIG. 4 is an alternative embodiment of a spring clip of the present invention.
Figure 5:
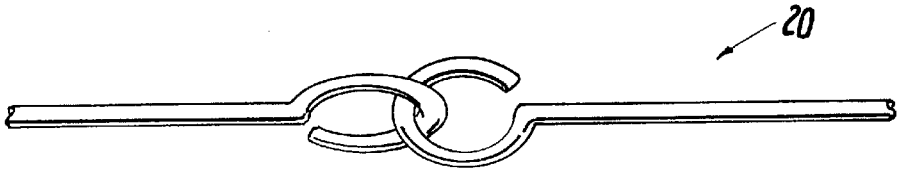
FIG. 5 (Prior Art)
FIG. 5 is a perspective view of the interlocking horizontal arms of the prior art clip shown in FIG. 1.
Figure 6:
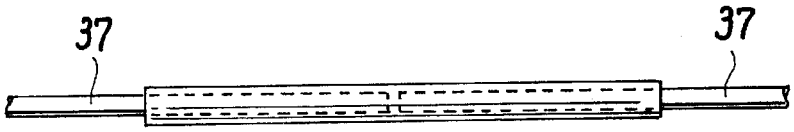
FIG. 6 is a top view of the horizontal arms and retaining element of the spring clip shown in FIG. 4.
Figure 7:
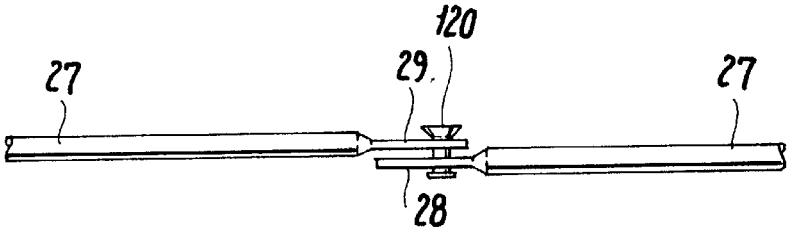
FIGS. 7 and 8 re side and top views of the horizontal clips shown in FIGS. 2 and 3 wherein the alternative embodiments of the horizontal arms are both shown in the closed position.
Figure 8:
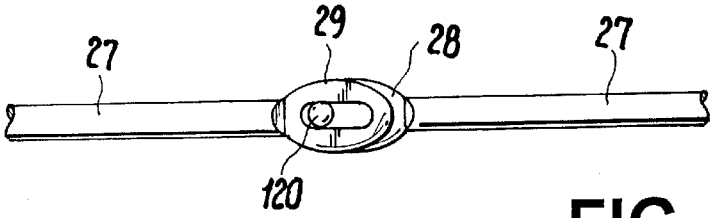

The alternative preferred embodiment shown in FIG. 4 provide a similar construction to that shown in FIGS. 2 and 3, except that the ends of the horizontal bars are simply abutted and held in place with a metal wrap 38. The wrap must provide sufficient play relative to the ends 37 such as to not restrict the movement of the horizontal bars 37. In the preferred embodiment, the wrap 38 is at least slightly greater than one half of the width of the horizontal span of the bar 37 plus the maximum opening of the bars 37. This ensures that even if the wrap slides to one end of the bars 37, the abutting ends of the bars 37 will not be exposed when they are opened and closed. In a preferred embodiment, the wrap 38 will extend almost the entire length of the horizontal bars 37 when they are in their closed position. In addition, the line of joinder 39 of the wrap 38 is treated so as not to provide any sharp edges.

The above is intended to provide examples of the preferred embodiment of the present invention. Further embodiments of the invention will become obvious to those skilled in the art once the present invention is described or shown as set forth herein. The applicant's invention is intended to be limited by the scope of the claims only and not by the specific embodiments set forth in this description.

What is claimed is:

1. A spring clip comprising:

a sliding horizontal bar having a first bar element and an overlapping second bar element wherein a respective axis of the first and second bar elements are generally parallel to each other and are slideably attached to each other with a pin element such as to provide limited resilient expansion of the horizontal bar along the respective axis of the first and second bar elements relative to each other in all other directions, a resilient button receiving portion for engaging and disengaging a button type projection, and a pair of arms coupling said sliding horizontal bar to said button receiving portion for translating the resilient expansion of said button receiving portion to said sliding horizontal bar.

2. The spring clip of claim 1 where the sliding horizontal bar, the pair of arms and the button receiving portion of the spring clip are formed from a single piece of wire and at least one of the first and second bar elements includes an aperture defining the permitted slide movement of the horizontal bar.

3. The spring clip of claim 2 wherein the first and second bar elements are coupled with the pin element which is engaged in a fixed position relative to one of the two bar elements and is fitted to be received into the aperture of the at least one bar element having the aperture.

4. The spring clip of claim 3 wherein the pin element is a riveted pin element having a first head portion a middle length portion and a second head portion, wherein the two bar elements are secured between the first and second head portion and are received in the middle length portion such as to permit resilient motion of the first and second bar elements relative to each other.

5. A spring clip formed from a continuous wire for engaging and disengaging a button, said spring clip comprising:

a pair of spring arms having a first contracted end and a second contracted end positioned to form a button receiving opening, a pair of strap bar receiving ends integral to the pair of spring arms, a button receiving portion coupled to the contracted ends of the pair of spring arms, and a horizontal bar formed by a pair of overlapping sliding portions slideably coupled to each other with a pin element providing for the expansion of the horizontal bar upon the expansion of the button receiving portion of the spring clip, said pair of overlapping sliding portions extending from the pair of strap bar receiving ends respectively.

6. An improved clip formed from a single piece of resilient wire and riveted pin element, said clip including a button receiving portion for engaging and disengaging a button, a horizontal bar and a pair of arms connecting said horizontal bar to said button receiving portion, wherein said improvement comprises overlapping and interlocking pin means on the horizontal bar to permit limited non-deforming resilient movement of the button receiving portion of the spring clip upon the repeated engagement and disengagement of the button.

7. A spring clip comprising:

a) a horizontal bar with a length including:

a first bar element defining a first slide aperture; and a second bar element overlapping the first bar element, the second bar element defining a second slide aperture;

b) a pin element slideably mounted in the first and second slide apertures for coupling the first and second bar elements and for providing a limited resilient variation of the length of the horizontal bar;

c) a resilient button receiving portion for engaging and disengaging a button type projection; and d) a pair of arms coupling the horizontal bar to the button receiving portion for translating the limited resilient variation of the length of the horizontal bar to the button receiving portion.

* * * * *